United States Patent [19]

Snader et al.

[11] 4,026,683

[45] May 31, 1977

[54] INLET DUCT AND HOPPER APPARATUS FOR ELECTROSTATIC PRECIPITATORS

[75] Inventors: Earle Stuart Snader, Pasadena; John Leo McKewen, Cockeysville, both of Md.

[73] Assignee: Environmental Elements Corporation, Baltimore, Md.

[22] Filed: Nov. 20, 1975

[21] Appl. No.: 633,571

[52] U.S. Cl. ..... 55/108; 55/129; 55/133

[51] Int. Cl.[2] ..... B03C 3/76; B03C 3/88

[58] Field of Search ..... 55/112, 128, 129, 133, 55/136, 137, 138, 418, 420, 108, 101

[56] References Cited

UNITED STATES PATENTS

| | | | |
|---|---|---|---|
| 2,497,169 | 2/1950 | Herber et al. | 55/129 |
| 2,812,035 | 11/1957 | Sohlman et al. | 55/112 |
| 3,733,785 | 5/1973 | Gallaer | 55/129 |
| 3,853,511 | 12/1974 | Huppi | 55/128 |
| 3,891,414 | 6/1975 | Snader | 55/128 |
| 3,951,624 | 4/1976 | Snader | 55/128 |

FOREIGN PATENTS OR APPLICATIONS

| | | | |
|---|---|---|---|
| 44-12478 | 8/1969 | Japan | 55/112 |

*Primary Examiner*—Frank W. Lutter
*Assistant Examiner*—David L. Lacey
*Attorney, Agent, or Firm*—Herbert J. Zeh, Jr.; Oscar B. Brumback

[57] ABSTRACT

Electrostatic precipitator apparatus for cleaning a particle-laden gas flowing therethrough including a shell with a gas inlet duct and outlet duct, spaced collector electrodes suspended within the shell defining gas passages therebetween, discharge electrodes suspended within the gas passages for ionizing particles in the gas for collection by the collector electrodes, and hoppers suspended below the collector electrodes for collecting the particles dislodged therefrom. The inlet duct includes a gas distribution baffle having a rigid pervious upper portion and flexible substantially impervious lower portion, preferably a chain curtain, to permit particle accumulations in the inlet duct to pass into the shell for collection in the hoppers. A similar baffle assembly is suspended within each of the hoppers transverse to the gas flow for obstructing the flow of gas through the hoppers and to prevent the particles from becoming lodged between the hopper and the baffle assembly upon discharge of the particles from the hopper.

8 Claims, 6 Drawing Figures

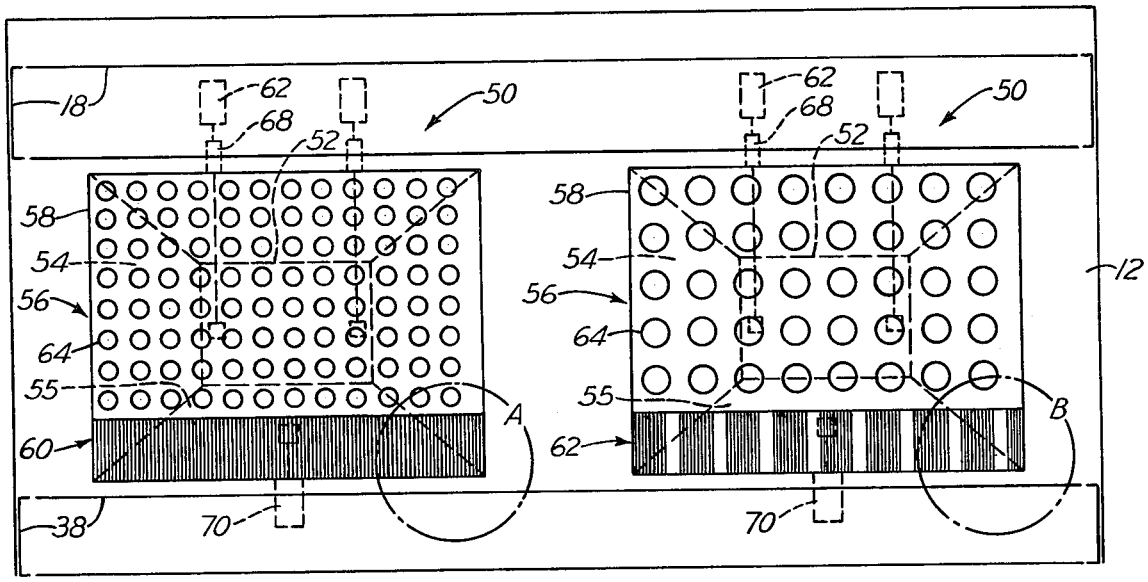
Fig. 2
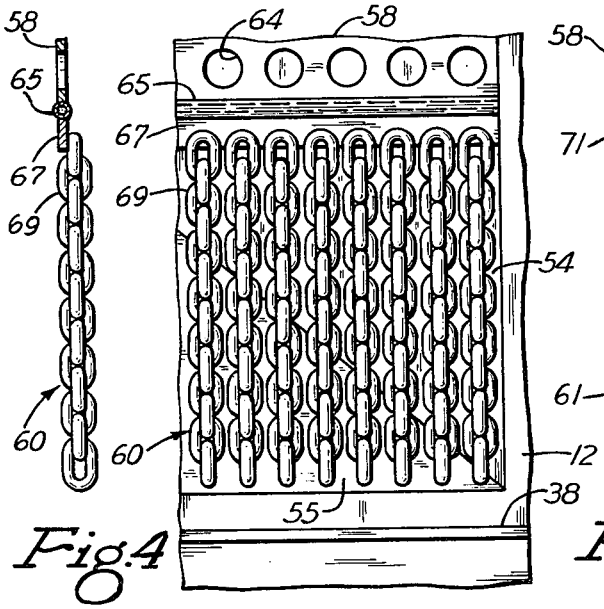
Fig. 4
Fig. 3
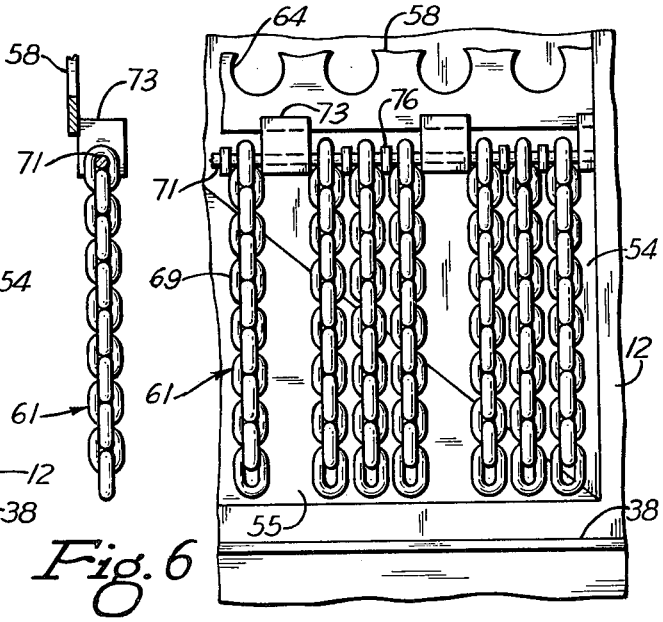
Fig. 6
Fig. 5

INLET DUCT AND HOPPER APPARATUS FOR ELECTROSTATIC PRECIPITATORS

CROSS REFERENCES TO RELATED APPLICATIONS

This application is co-pending with application Ser. No. 526,201, filed May 16, 1975 now U.S. Pat. No. 3,951,624 by Earle S. Snader entitled "Electrostatic Precipitator" and assigned to the assignee of this application.

BACKGROUND OF THE INVENTION

1. Field of the Invention

This invention relates generally to gas separation by electrostatic precipitators and more particularly to baffle assemblies used within the inlet duct and the particle collection hoppers thereof for maintaining the inlet duct free of particles and reducing re-entrainment of particles in the hoppers into the gas stream without interfering with emptying of the hoppers.

2. Description of the Prior Art

As mentioned in the aforementioned co-pending application, the removal of particles from a gas stream by electrostatic precipitators is well known in the art. A typical electrostatic precipitator of the plate type which removes particles from a gas flowing therethrough is illustrated in Ragland Pat. No. 3,425,190. In such precipitators, gas flows through an inlet duct into the precipitator and through gas passages formed between rows of vertical collecting plates. Some precipitators are extremely large and usually include more than one set of laterally spaced collecting plates extending along the length of the precipitator from the inlet to outlet side. A plurality of discharge wire electrodes, electrically insulated from the shell, are suspended within each of the gas passages between the collector electrodes. As the gas passes through the gas passages, the discharge electrodes ionize the particles in the gas which are then attracted to and collected on the vertical collector electrodes. The particles which collect on the collector electrodes are removed therefrom and fall to the bottom of the precipitator. As shown in the Ragland Patent, the bottom of the precipitator contains a plurality of hoppers into which the dust particles fall, are collected, and then removed through the bottom of the hopper.

Preferably, one hopper is suspended under each set of collector electrodes to collect the particles falling from the electrodes in each set. The gas flows beneath the collector electrodes in the associated hopper of each set before being forced back up into the gas passages of the remaining sets of electrodes by the walls of each hopper. In this way, maximum precipitation of the entire gas is assured and particles from the hoppers re-entrained in the gas flowing beneath the collector electrodes are acted upon by the discharge electrodes in the remaining sets.

Although it is preferable to have an individual hopper below each set of collector electrodes, it has been found that it is impractical to do so because of the high cost of manufacturing and installing individual hoppers under each set because of the cost of the apparatus for hook up to the hoppers to remove the particles. Therefore, one larger hopper is usually placed under two sets of collector electrodes. However, this causes the gas stream flowing beneath the collector electrodes within each hopper to pass by two sets of collector electrodes before it is forced back up into the gas passages by the sides of the hopper. Thus, particle collection is not as efficient as it would be with a hopper under each set of electrodes. To overcome this condition, it is now common practice to secure rigid baffles within each hopper between adjacent sets of collector electrodes which extend downward to a point just above the bottom of the hopper. This baffle system obstructs the flow of gas beneath the collector electrodes and forces the gas back up into the gas passages after it flows beneath only one set of collector electrodes.

However, one disadvantage of this arrangement is that the baffle extending down to the small outlet of the hopper effectively cuts in half the space through which the particles must pass for disposal. The particles falling into the hopper on each side of the baffle assembly tend to lodge between the sides of the hopper and the baffle. In addition, particles which collect and cool in the hopper often tend to form a sticky and thick agglomerate, sometimes even forming a bridge of particles between the wall of the hopper and the baffle. If the particles are allowed to cool too long, they become extremely hard and prevent discharge of the particles from the hopper and must often be manually broken loose by jackhammers or other physical means. The invention of the aforementioned co-pending application overcomes this problem as fully explained therein.

In addition, the inlet ducts that direct the gas into the precipitator usually include gas distrubution baffles to control the distribution of gas flowing into the precipitator. Some of the particles in the gas stream collect on the baffle and eventually fall, or are dislodged by a baffle rapper, onto the bottom of the duct where they collect ahead of the baffle. The particles continue to build up on the duct until they interfere with the flow of gas at which time they must be manually removed such as by shoveling. It should be understood that the precipitator must be shut down during the removal of such accumulations.

Accordingly, an object of this invention is to provide improved inlet duct and hopper apparatus for electrostatic precipitators; more particularly, an object is to provide means for preventing the build-up of particles in the inlet duct and to remove such particles during normal operation, to provide a means for preventing particles from lodging between the sides of the hoppers and the hopper baffles, and especially to provide a precipitator having both such means to improve its operation.

SUMMARY OF THE INVENTION

These and other objects and advantages are generally accomplished by providing baffle means secured within each of the hoppers of a precipitor, transverse to the gas flow, each of the baffle means having an impervious rigid portion extending between lower portions of adjacent sets of the collector electrodes and ending substantially above a bottom outlet end of the hopper and with a flexible substantially impervious portion connected to the bottom of the rigid portion and extending downward to the outlet end of the hopper for obstructing the gas flow in the hopper to force the gas in the hoppers upwardly into the gas passages. The flexible portion prevents particles from becoming lodged between the sides of the hopper and the baffle means upon discharge of the particles from the hopper.

In addition, the inlet duct is provided with a gas distribution baffle assembly having a rigid pervious top portion and either a flexible, substantially impervious, bottom portion or a flexible, pervious, bottom portion. The flexible bottom portion of the baffle permits particle accumulations on the bottom of the inlet duct to slide forward and downward into the precipitator shell and into the first hopper for removal during normal operation of the precipitator. If desired, additional rapper means may be used to vibrate the bottom of the inlet duct to cause the particles to slide thereon. Advantageously, the flexible portions of the inlet duct distribution baffle and hopper baffles may be formed by a number of chains hanging from the rigid upper portions to form a flexible chain curtain. The closely spaced chains form a substantially impervious portion and effectively obstruct the flow of gas in the hoppers and also below the pervious portion of the inlet duct baffle; however, the chains on the inlet duct distribution baffle may be spaced to provide a gas flow therethrough corresponding substantially to the flow through the rigid pervious portion of the baffle.

The above and further objects and novel features of the invention will appear more fully from the following detailed description when the same is read in connection with the accompanying drawings; it is to be expressly understood, however, that the drawings are not intended as definition of the invention but are for the purpose of illustration only.

BRIEF DESCRIPTION OF THE DRAWINGS

In the drawings wherein like parts are marked alike:

FIG. 2 is a schematic illustration of the inlet duct side of the precipitator taken along lines II—II of FIG. 1 looking into the gas flow and showing the distribution baffle assembly within the inlet duct;

FIG. 3 is an enlarged view of a part of the flexible portion of the distribution baffle assembly as indicated by the circle "A" in FIG. 2 showing the rigid upper portion and the flexible chain curtain lower portion;

FIG. 4 is an end view of FIG. 3 showing the connection of the chain curtain to the rigid upper portion;

FIG. 5 is an enlarged view of a part of the flexible portion of a modified form of distribution baffle assembly as indicated by the circle "B" in FIG. 2; and FIG. 6 is an end view of FIG. 5 showing the connection of the modified chain curtain to the rigid upper portion.

DESCRIPTION OF THE PREFERRED EMBODIMENT

Figure 1:
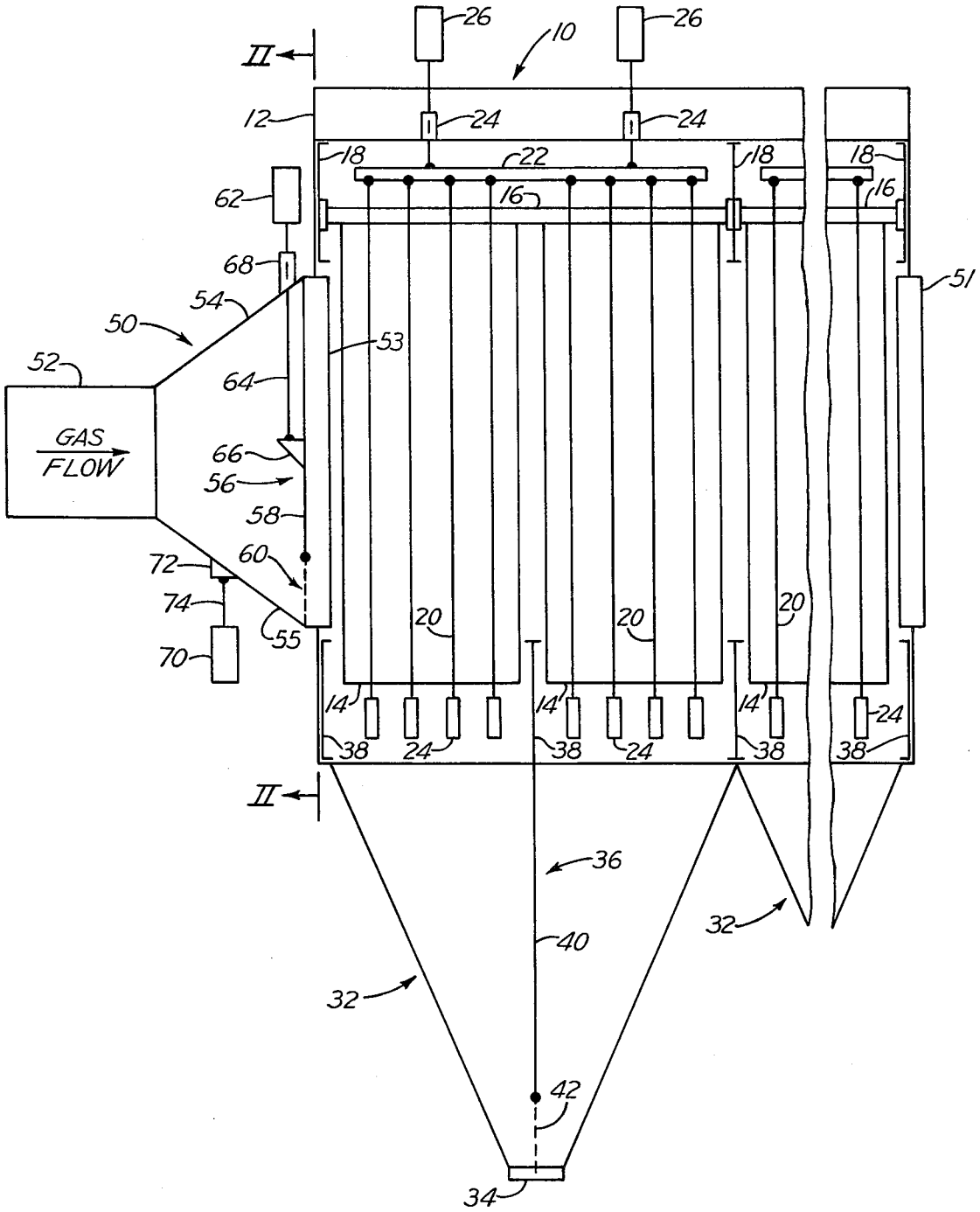
FIG. 1 is a schematic illustration in side elevation of an electrostatic precipitator of the present invention.

The present invention generally comprises in combination an electrostatic precipitator having an inlet duct and collection hoppers modified to include baffle means to control the accumulation of particles in the duct and hoppers. A description of the baffle means in the hoppers may be found in the aforementioned co-pending application Ser. No. 526,201 to which reference may be made for a detailed description.

Briefly, FIG. 1 schematically illustrates an electrostatic precipitator generally denoted by numeral 10 that includes a shell 12 defining a gas chamber therein in which a plurality of collector electrode plates 14 are suspended by structural members 16 secured to superstructure members 18 in the conventional manner. Thus, a number of gas passages are formed between a number of laterally spaced collector electrodes 14 along the length of the precipitator 10. A plurality of discharge electrode wires 20 are suspended from a support structure 22 so as to hang in the gas passages between the collector plates 14. Weights 24 on the ends of wires 20 maintain the wires taut. A wire weight guide assembly (not shown) may be used to prevent the wires from swinging. The support structure 22 is insulated from the shell 12 by insulators 24 and conventional rappers 26 are connected to the support structure through the insulators 24 to vibrate the support structure 22 to dislodge dust particles that cling to the wires. Similar rappers (not shown) are connected to structural members 16 for vibrating the collector plates 14 to dislodge dust particles therefrom which fall downward into collection hoppers beneath the collector plates 14.

The precipitator includes collection hopper assemblies generally denoted by numeral 32 secured to the shell 12 beneath the collector and discharge electrodes to catch the particles disloged therefrom as fully described in the aforementioned co-pending application. Each hopper 32 spans two longitudinally spaced sets of collector plates 14 as shown in FIG. 1.

Briefly, hoppers 32 include an outlet 34 from which particle accumulations in the hopper are removed. A baffle assembly generally denoted by numeral 36 is secured to a part of the superstructure 38 so as to hang in vertical alignment above the hopper outlet as shown in FIG. 1. The baffle assembly 36 includes an impervious rigid upper portion 40 and a substantially impervious flexible lower portion 42 secured to the rigid portion 40. As fully explained in the prior application, dust particle accumulations in the hopper 32 cannot form bridges between the flexible portion 42 and the sides of the hopper. In addition, since the flexible portion 42 is freely movable, uneven accumulations of dust on either side of the rigid portion 40 move the flexible portion 42 and permits the dust to fall freely through the outlet 34 when the hopper is emptied. A further advantage of the flexible portion 42 is that it serves, with the rigid portion 40, to direct gas, tending to flow into the hopper, upward into the gas stream above the superstructure members 38 thereby reducing re-entrainment of particles contained in the hopper. The flexible portion 42 is preferably formed from a series of chains hanging side by side along the lower edge of the rigid portion 40 forming a chain curtain. Although the curtain is slightly pervious, it obstructs the flow of gas tending to flow through it to the extent that it is substantially impervious.

The precipitator 10 also includes an inlet duct generally denoted by numeral 50 and an outlet duct 51 as shown in FIG. 1. Inlet duct 50 includes a supply duct 52 for the gas and a diverging transition section 54 connecting the supply duct 52 to the shell 12 of precipitator 10. The divergence of gas in the transition or expansion section 54 permits high velocity gas from the supply duct 52 to expand thereby dropping its pressure prior to entry into the precipitator. The transition section 54 is in the shape of a truncated pyramid with the truncated end connected to the supply duct 52 and the base connected to the shell 12 around an opening 53 in the shell. Thus, the transition section 54 has sloping sides all around of which the bottom side 55 slopes downward from the supply duct 52 to the shell 12.

The inlet duct 50 includes a baffle assembly generally denoted by numeral 56, secured adjacent to the shell 12, that extends across the base portion of the transition section 54 as shown in FIG. 1. The baffle assembly 56 includes a pervious rigid upper portion 58 secured to the sides of the transition section 54 in the usual manner and includes a substantially impervious flexible lower portion 60 connected to the lower edge of the upper portion 58 but hanging loosely therefrom and not connected to the bottom side 55 of the transition section 54. The rigid upper portion is perforated in the usual manner to control the distribution of the gas flowing into the precipitator 10. Ordinarily, dust particles cling to the upstream side of the rigid portion 58 and, in this invention, to the upstream side of the flexible portion 60. These particles eventually fall, or are dislodged, from the distribution baffle assembly 56 onto the sloped bottom side 55 of the transition section 54. When a conventional rigid baffle is used that extends completely between the top and bottom sides of the transition section 54, the dust falling from the baffle assembly 56 forms an accumulation of particles on the bottom side 55. The particles continue to accumulate until they obstruct the flow of gas into the precipitator at which time the precipitator must be shut down and the particles physically removed, such as by shoveling them out, which is a time consuming and laborious task. In accordance with this invention, as the dust particles accumulate on the bottom side 55, they tend to slide downward and their weight pushes the flexible portion 60 aside so that the particles continue to slide into the precipitator 10 and downward into the first hopper 32 from where they are removed with the other particles therein.

If desired, a conventional rapper assembly 62 may be connected to a bracket 66 on the rigid portion 58 by a rapper rod 64 passing through a conventional dust proof jacket 68 in transition section 54. Thus, energization of the rapper 62 vibrates both the rigid portion 58 and flexible portion 60 to dislodge the dust particles thereon causing them to fall on sloping side 55. Since the physical requirements of the inlet duct 50 may result in a bottom side 55 having an angle of inclination less than the angle of repose of the accummulation of dust particles, an additional rapper assembly 70 may be connected to a bracket 72 on the bottom side 55 by a rapper rod 74 to vibrate the sloping side 55 thereby causing the dust accumulations thereon to slide downward into the precipitator. In some instances, it may be desirable to vibrate the sloping side 55 frequently or even continuously to prevent large accumulations of dust particles from forming thereon.

More specifically, FIG. 2 shows the baffle assembly 56 in inlet duct 50 as seen when looking into the gas flow. Two inlet ducts 50 are shown side by side of which the one on the right is a modified form of the one on the left. Both ducts would normally be identical but, for the sake of convenience, both types are shown in FIG. 2. As shown on the left side of FIG. 2, the upper rigid portion 58 comprises a flat plate with a number of holes 64 formed therein. The number and size of the holes 64 are selected in accordance with conventional practice to provide the desired amount of impedance to flow of gas to control the distribution of the gas entering the precipitator.

The flexible portion 60 of the baffle assembly 56 preferably comprises a plurality of chains 69 supported from the lower edge of upper portion 58. This arrangement is shown in greater detail in FIGS. 3 and 4. As shown in FIG. 3, a tube or rod 65 is fastened, such as by welding, to the lower edge of upper portion 58 to stiffen it. Similarly, a narrow strip 67 is welded along the bottom of the tube 65 as best shown in FIG. 4. The lengths of chains 69 are fastened to the strip 67 such as by welding the top links of each chain thereto. Thus, it can be seen that the lengths of chains 69 hang from the lower edge 67 of the upper portion 58 and extend downward to be in contact, or nearly in contact, with the sloping side 55 of the transition section 54. This arrangement provides a flexible portion or chain curtain 60 hanging along the bottom of the baffle assembly 56. Being flexible, the chains will move toward the shell 12, as viewed in FIG. 1, to permit accumulations of dust particles ahead of the chains to slide downward along the sloping side 55 and into the precipitator. As shown in FIG. 3, the closely spaced chains 69 hang side by side forming a chain curtain across the width of the baffle assembly 56 and beneath the rigid distribution plate 58. Although the chains 69 themselves are slightly pervious, the curtain obstructs the gas tending to flow through it to the extent that it is substantially impervious.

As previously mentioned, the number and size of the holes 64 in the upper portion 58 are selected to control the distribution of gas flowing into the precipitator. Similarly, the size of the links in chains 69 and the spacing of the chains across the width of the plate 58 may be selected to provide substantially the same amount of gas flow through the chains as through the upper portion 58. As shown on the right side of FIG. 2, the chains may be loosely spaced, individually or in small groups, across the width of the upper plate 58 as shown to provide a larger gas flow. That is, three lengths of chains 69, for example, may be placed side by side to form a group with a space between them and the next group as best shown in FIG. 5. FIG. 5 also illustrates a convenient means of suspending the chains 69 in such groups to achieve the desired gas flow through the spaced chain curtain generally denoted 61. A rod 71 passes through the openings in the upper links of the chains and through holes in support brackets 73 which themselves are secured to the bottom edge of the upper portion 58 such as by welding. This arrangement is further illustrated in FIG. 6, being an end view of FIg. 5. Spacers 76 placed on the rod 71 may be used to maintain the chains 69 in the desired lateral positions across the width of upper portion 58.

Those skilled in the art will recognize that the gas from the inlet duct 50 should be directed into the precipitator 10 such that it flows across the height of the collector electrodes 14. The inlet duct 50 illustrated in FIG. 1 directs the gas in this manner; it can also be seen that, in this instance, the chain curtain 60 should be of the pervious type shown on the right side of FIG. 2 and in FIG. 5 so as not to obstruct the flow of gas towards the bottom portions of the collector plates 14. Also, in this instance, the length of chains 69 should be selected so that the bottom edge of the rigid upper portion 58 is about the same height above the sloping surface 55 of transition section 54 as the height of the dust particles expected to accumulate on surface 55. Thus, the rigid plate 58 will not interfere with the travel of the dust down the sloping plate 55 and the chain curtain will not interfere with the flow of gas toward the bottom area of the precipitator.

Sometimes, however, and for various reasons, the bottom plate 55 will be located below the bottom portions of the collector plates 14. Therefore, the gas should be obstructed along the lower part of the inlet duct 50 so that it flows toward the bottom of collector plates 14. Thus, in this instance, a chain curtain 60, such as shown on the left side of FIG. 2 and in FIG. 3, should be used to obstruct the flow of gas along the bottom area of inlet duct 50; that is, the chain curtain will be substantially impervious to the flow of gas. Then, in this instance, the length of chains 69 would be selected so that the bottom edge 67 of pervious baffle 58 (FIG. 3) would be about even, vertically, with the bottom edges of the collector plates 14. If necessary, of course, the length of chains 69 can be selected to accommodate the height of the dust particles expected to accumulate on sloping surface 55.

Although the gas transition section 54 has been illustrated as having sloping sides all round, it should be understood that the top and lateral sides thereof may extend horizontally, straight from the supply duct 52 to the inlet side of shell 12 with only the bottom side 55 sloping towards the precipitator 10. This arrangement can, if necessary, provide the desired amount of expansion area in the transition section 54 while permitting the bottom side 55 to be sloped at a greater angle. Thus, the dust particles on sloping side 55 will have a greater tendency to slide forward into the precipitator.

The baffle assembly 56 has been shown as having a number of holes; however, it should be understood that the holes may be in the form of vertical or horizontal slots and, in addition, such slots may be formed as conventional flow vanes to direct the gas flow evenly into the precipitator 10.

As mentioned above, FIG. 2 shows two inlet ducts 50 horizontally side by side. However, a single inlet duct 50, or even more than the two ducts shown, may be used, depending on the size of the precipitator. Similarly, the inlet ducts 50 may be placed one on top of the other.

The hopper 32, as well as the baffle assembly 36 therein, may also have conventional rappers connected thereto (not shown) for dislodging dust particles clinging to the sides of the hopper and faces of the baffle. The baffle assembly 56 in the transition section 54 has been shown, in FIG. 2, as having two rapper assemblies 62 connected thereto; either single or multiple rappers may be connected to the upper portion 58, depending on the size of the plate. Likewise, the sloping side 55 may be provided with more than the one rapper 70 as shown in FIGS. 1 and 2.

As shown in FIG. 1, the baffle assembly 56 is secured near to or adjacent the opening in shell 12; however, it may be placed in direct vertical alignment with the opening or further upstream in the transition section 54. Placement of the baffle assembly 56 depends somewhat on the shape of the transition section and somewhat on the impedance to gas flow that is desired as well understood by those skilled in the art. For example, it may be desirable, to achieve the desired gas distribution, to use more than one distribution baffle 58 in which case each baffle would be constructed with the appropriate chain curtain 60 or 61 to provide a plurality of baffle assemblies 56 spaced along the length of transition section 54. Usually, one baffle assembly 56 would be located in or adjacent opening 53 in shell 12; any additional assemblies would be located upstream, their spacing determined mostly by the characteristics of the gas distribution achieved by the rigid pervious plate 58.

Thus, the invention having been shown in its best embodiment and mode of operation, that which is desired to be claimed by Letters Patent is:

1. An improved electrostatic precipator apparatus for cleaning a particle-laden gas flowing therethrough of the type comprising in combination:

shell means having a gas inlet duct means and a gas outlet duct means and defining a gas chamber therein;

a plurality of spaced collector electrode plate means suspended within said shell means and defining gas passages therebetween;

a plurality of discharge electrode wire means suspended within said gas passages for ionizing particles in said gas for collection on said collector electrode means; and hopper means secured below said shell means for collecting particles dislodged from said collector electrode means;

wherein the improvement comprises said gas inlet duct means having a gas flow transition section of which at least a sloped bottom portion thereof extends downward from a supply duct portion to the inlet side of said shell means and also having a gas distribution baffle means within said transition section for controlling the distribution of said particle-laden gas entering said precipitator, said baffle means including a rigid pervious upper portion and a flexible lower portion for permitting particles accumulating on said sloped bottom portion to slide into said shell means for collection in said hopper means.

2. The apparatus of claim 1 wherein said flexible lower portion comprises a plurality of laterally spaced flexible members suspended from a lower edge of said pervious upper portion and extending therefrom to said sloped bottom portion of said transition section.

3. The apparatus of claim 2 wherein said flexible members comprise a plurality of closely spaced chains suspended from said lower edge of said upper portion forming a flexible, substantially impervious, chain curtain beneath said pervious upper portion to obstruct the flow of gas therethrough.

4. The apparatus of claim 2 wherein said flexible members comprise a plurality of chains suspended from said lower edge of said upper portion and spaced apart to form a flexible, pervious, chain curtain beneath said pervious upper portion to restrict the flow of gas therethrough substantially equal to the restriction provided by said rigid portion.

5. The apparatus of claim 2 further including first rapper means connected to said baffle means for dislodging particles therefrom onto said sloped bottom portion.

6. The apparatus of claim 5 further including a second rapper means connected to said sloped bottom portion for dislodging accumulations of particles thereon for downward movement along said bottom portion.

7. The apparatus of claim 2 further including a hopper baffle means, in said hopper means, extending transversely to the gas passages for obstructing the flow of said gas in said hopper means, said hopper baffle means including:

an impervious rigid upper portion extending from between a lower portion of adjacent collector electrode plates toward a bottom outlet of said hopper means; and a flexible, substantially impervious, lower portion connected to a lower edge of said impervious upper portion and extending into said bottom outlet.

8. The apparatus of claim 7 wherein said flexible lower portion comprises a plurality of closely spaced chains suspended from said lower edge of said impervious upper portion forming a flexible, substantially impervious, chain curtain beneath said impervious upper portion to obstruct the flow of gas therethrough.

* * * * *